US005469323A

United States Patent [19]

Kanayama

[11] Patent Number: 5,469,323

[45] Date of Patent: Nov. 21, 1995

[54] METHOD AND APPARATUS FOR TRAPPING CHARGED PARTICLES

[75] Inventor: Toshihiko Kanayama, Tsukuba, Japan

[73] Assignee: Agency of Industrial Science and Technology, Tokyo, Japan

[21] Appl. No.: 846,163

[22] Filed: Mar. 5, 1992

[30] Foreign Application Priority Data

Mar. 26, 1991 [JP] Japan ..... 3-086120

[51] Int. Cl.[6] ..... H01J 49/34

[52] U.S. Cl. ..... 361/225; 361/234

[58] Field of Search ..... 361/225–226, 361/233, 234, 144, 143, 231, 235; 324/464; 250/282, 292, 291; 307/2, 56, 45, 100; 363/74, 78, 80, 83; 323/32, 93, 100

[56] References Cited

U.S. PATENT DOCUMENTS

| | | | |
|---|---|---|---|
| Re. 34,000 | 7/1992 | Syka et al. | 250/292 |
| 4,755,670 | 7/1988 | Syka et al. | 250/292 |
| 4,835,392 | 5/1989 | Löschner et al. | 250/492.2 |
| 4,870,284 | 9/1989 | Hashimoto et al. | 250/283 |
| 4,990,856 | 2/1991 | Anderson et al. | 324/464 |
| 5,051,582 | 9/1991 | Bahns et al. | 250/290 |
| 5,155,651 | 9/1992 | Yoda et al. | 361/144 |
| 5,179,278 | 1/1993 | Douglas . | |

OTHER PUBLICATIONS

H. G. Dehmelt, "Radiofrequency Spectroscopy of stored Ions I: Storage , and II: Spectroscopy" pp. 54–72; 108–125.

F. G. Major, et al., "Exchange–Collision Technique for the rf Spectroscopy of Stored Ions", Physical Review, vol. 170, No. 1, Jun. 5, 1968, pp. 92–107.

E. Fischer, "Die dreidimensionale Stabilisierung von Ladungstragern in einem Vierpolfeld", Zeitschift fur Physik 156, Apr. 1959, pp. 1–26.

P. H. Dawson et al., "Ion Storage in Three–Dimensional, Rotationally Symmetric, Quadrupole Fields. I. Theoretical Treatment", The Journal of Vacuum Science and Technology, vol. 5, No. 1, (Jul. 1967), 1–10.

P. H. Dawson et al., "Ion Storage in Three–Dimensional, Rotationally Symmetric, Quadrupole Fields. II. A Sensitive Mass Spectrometer", The Journal Fo Vacuum Science and Technology, vol. 5 No. 1, (1967) pp. 11–18.

R. F. Wuerker et al., "Electrodynamic Containment of Charged Particles, Journal of Applied Physics", vol. 30, No. 3 (Mar. 1959) pp. 342–349.

"Radiative decay rates of metastable Ar III and Cu II ions", Prior, Physical Review A, vol. 30, No. 6, Dec. 1984, pp. 3051–3056.

"A Method for the Neutralization of Electron Space Charge by Positive Ionization At Very Low Gas Pressures" Kingdon, pp. 408–418.

"Electron capture by trapped $Ne^{q+}$ ions at very low energies", Prior et al., Physical Review A, vol. 28, No. 1, Jul. 1983, pp. 141–149.

"Demonstration of new Paul–Straubel trap for trapping single ions" Yu et al., J. Appld. Phys. 69 (6), Mar. 15th, 1991, pp. 3779–3781.

"Das elektrische Massenfilter als Massenspektrometer und Isotopentrenner" Zeitschrift fur Physik, Bd. 152 (1958). Paul et al.

*Primary Examiner*—Jeffrey A. Gaffin
*Assistant Examiner*—Aditya Krishnan
*Attorney, Agent, or Firm*—Spencer, Frank & Schneider

[57] ABSTRACT

A method and apparatus for trapping charged particles employs at least one central electrode. An AC voltage and a DC voltage are superimposed and are applied to the central electrode resulting in an AC electric field having an intensity which declines with an increase in the distance from the central electrode, and a DC electric field which attracts charged particles forces toward the central electrodes. Charge particles are trapped in the space outside the central electrode by these fields. A wide trapping range in terms of mass and energy can be achieved with a high trapping density. The central electrode can consist of four element electrodes which are supplied with AC voltages superimposed on a DC bias voltage in such a manner that respective adjacent element electrodes are supplied with opposite phase AC voltages.

25 Claims, 8 Drawing Sheets

METHOD AND APPARATUS FOR TRAPPING CHARGED PARTICLES

BACKGROUND OF THE INVENTION

1. Field of the Invention

The present invention relates to a method and apparatus for trapping charged particles such as electrons or ions in a particular space by an electromagnetic means.

2. Description of the Prior Art

FIGS. 1A–1C illustrate conventional apparatuses for trapping charged particles in a space: FIG. 1A shows a conventional quadrupole mass spectrometer; FIG. 1B shows a Paul trap for three-dimensionally confining charged particles on the same principle as in FIG. 1A; and FIG. 1C shows a Penning trap that operates on the basis of an electric field and a magnetic field which are orthogonally applied.

In FIG. 1A, four trapping electrodes 31–34 surround a space in which charged particles are to be stably contained. Two opposing electrodes 31 and 33 of the four electrodes are supplied with a radio frequency voltage from an alternating current power supply 2 as shown in FIG. 1A so that a radio frequency electric field is produced in the space. This apparatus two dimensionally traps charged particles in the space surrounded by the electrodes 31–34 by utilizing the principle that the time averaged force that acts on the charged particles placed in the space directs such a direction as the gradient of the electric field reduces, when the radio frequency voltage is applied to the electrodes 31 and 33.

The apparatus of FIG. 1B three dimensionally traps charged particles in a space surrounded by trapping electrodes 35 and 36 and an annular electrode 37 whose surfaces are formed by a hyperboloid of revolution. The device of FIG. 1B traps charged particles on the same principle as that of FIG. 1A.

As clearly seen from the principle, the gradient of the electric field in the trapping space where the charged particles are to be confined must be made smaller than that around the space. Thus, the periphery of the trapping space must be surrounded compactly by the electrodes. The trapping principle of FIG. 1A is sensitive to the mass of the charged particles, as is apparent from the fact that the arrangement of FIG. 1A is extensively used as a mass spectrometer. This is because the trapping is achieved by oscillating the charged particles by the radio frequency electric field, and hence, no trapping force acts on particles of a great mass because of their small oscillation amplitude. In contrast, light particles collide against the electrodes 31–34 because of their large oscillation amplitude.

In FIG. 1C, the same electrodes as those of FIG. 1B are supplied with a voltage from a direct current power supply 3 so that charged particles are trapped in the z direction, and are diverged in the horizontal direction (or the r direction of FIG. 1C). At the same time, a magnetic field 39 in the z direction is generated by a pair of magnets 38. The direct voltage causes the charged particles to move away from the center in the horizontal direction, whereas the magnetic field 39 deflects the course of the movement so as to prevent the charged particles from running away. Since the force acting on the particles is proportional to the velocity of the particles, the trapping effect on heavy particles by the magnetic field 39 reduced even if the applied voltage to the electrode is maintained constant. Thus, the mass of particles that can be trapped is limited to a narrow range.

The conventional methods described above present the following problems:

(1) The mass of particles that can be trapped is limited to a narrow range.

(2) In the Penning trap as shown in FIG. 1C, if the charged particles lose their energy by scattering due to residual gas in a vacuum vessel, or the like, they move away from the center in the radial direction, and hence, escape from the trapping space or collide with the electrodes 35 and 37. As a result, this method cannot hold the particles in suspension for a long time. In addition, trapping heavy particles such as heavy ions requires an extremely large magnetic field, and therefore, the mass and energy that can be trapped are limited to small values. Thus, the method can be applied only to electrons or some light ions.

(3) In the methods of FIGS. 1A and 1B, the trapping space must be surrounded by the electrodes. This not only hinders the charged particles from entering the trapping space, but also hinders an electron beam or a light beam for measurement from being introduced into the space. Furthermore, in the conventional apparatuses, since the trapping space is surrounded with electrodes and such a trap must be performed in vacuum, there arises another problem in that the efficiency of raising the vacuum level of the trapping space reduced because of low evacuation conductance due to the electrodes surrounding the trapping space. Moreover, since the force for confining the particles is generated by the radio frequency electric field, the effective force for trapping becomes relatively small compared with the applied voltage. Therefore, the conventional apparatuses present a problem in that not only is the energy of the trapped particles limited, but also the density of the particles is low because the trapping force cannot oppose the electrostatic repulsion among the particles. In addition, there is another problem in that the charged particles cannot be trapped unless they are synchronized with the phase of the radio frequency voltage for the trap when they are led into the trapping space from the outside.

Thus, although the apparatuses of FIGS. 1A–1C have been employed for the purpose of mass spectrometry or trapped ion spectrometry, they have problems and restrictions when used for other purposes. In particular, in order to apply an electromagnetic trap method to charged particles for a material procedure, which treats materials held in suspension in a completely separated state from the inner walls of a vessel, such as crystal growth performed in a suspended state in space, a trap method is required that can trap particles a) at the outside of electrodes, b) in a wide mass range, c) in a wide energy range of particles, and d) with a high density.

SUMMARY OF THE INVENTION

Accordingly, it is an object of the present invention to provide a method and apparatus for trapping charged particles that can confine particles in the space outside of electrodes, in a wide mass range of particles, in a wide energy range of particles, and with a high density.

In a first aspect of the present invention, a method for trapping charged particles comprises the steps of:

generating a DC electric field exerting on the charged particles forces directing to a central electrode; and generating an AC electric field declining its intensity with an increase in the distance from the central electrode in such a manner that the DC electric field and the AC electric field are super imposed.

Here, the AC electric field and the DC electric field may have different attenuation characteristics with regard to the distance from the central electrode.

In a second aspect of the present invention, an apparatus for trapping charged particles comprises:

a central electrode;

an AC voltage source connected to the central electrode for generating an electric field declining its intensity with an increase in the distance from the central electrode; and a DC voltage source connected to the AC voltage source for generating an electric field exerting on the charged particles forces directed to the central electrode in such a manner that the DC electric field and the AC electric field are superimposed.

Here, the central electrode may consist of an even number of element electrodes which are symmetrically disposed around a central axis of the central electrode, the element electrodes being supplied by the AC voltage source in such a manner that any two adjacent element electrodes of the element electrodes are supplied with AC voltages of opposite phases.

The central electrode may comprise four element electrodes.

The central electrode may comprise a trapping space inside the even number of element electrodes so that charged particles are trapped inside the central electrode as well as outside the central electrode.

The central electrode may comprise a trapping space inside the four element electrodes so that charged particles are trapped inside the central electrodes as well as outside the central electrode.

An apparatus for trapping charged particles may further comprise an outer electrode provided outside the central electrode for defining motion of the charge particles.

The central electrode may be axially symmetrical and an outer electrode may be provided at each end of the central electrode.

The outer electrode may be made up of a casing of a vacuum vessel containing the central electrode.

The outer electrode may be made up of a casing of an isolation vessel containing the central electrode.

In a third aspect of the present invention, an apparatus for trapping charged particles comprises:

a central electrode;

an AC voltage source connected to the central electrode for generating an electric field declining in its intensity with an increase in the distance from the central electrode;

a DC voltage source connected to the AC voltage source for generating an electric field exerting on the charged particles forces directed to the central electrode in such a manner that the DC electric field and the AC electric field are superimposed;

an outer electrode provided outside the central electrode for defining motion of the charged particles;

an evaporation source provided outside the outer electrode for emitting a beam of ions and neutral atoms of an evaporation material toward the central electrode; and a shutter admitting or blocking the beam transmitting toward the central electrode.

Here, an apparatus for trapping charged particles may further comprise a drawout electrode and a channel plate outside the outer electrode so that charged particles inside the outer electrode are drawn out to be counted with the channel plate.

According to the present invention, charged particles can be trapped in the outer space of the electrode, in wide mass and energy ranges, with a high density. In addition, the trapped particles are arranged in the order of mass according to the separation from the center. Consequently, the method and apparatus of the present invention have remarkable effects when applied to a material processing, procedure which treats material held in suspension in a region or space completely separated state from the walls, such as growing fine crystals using the trapped particles as seeds, or reactions between the trapped particles or between the trapped particles and reaction gas.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

The invention will now be described with reference to the accompanying drawings.

Embodiment 1

Figure 2:
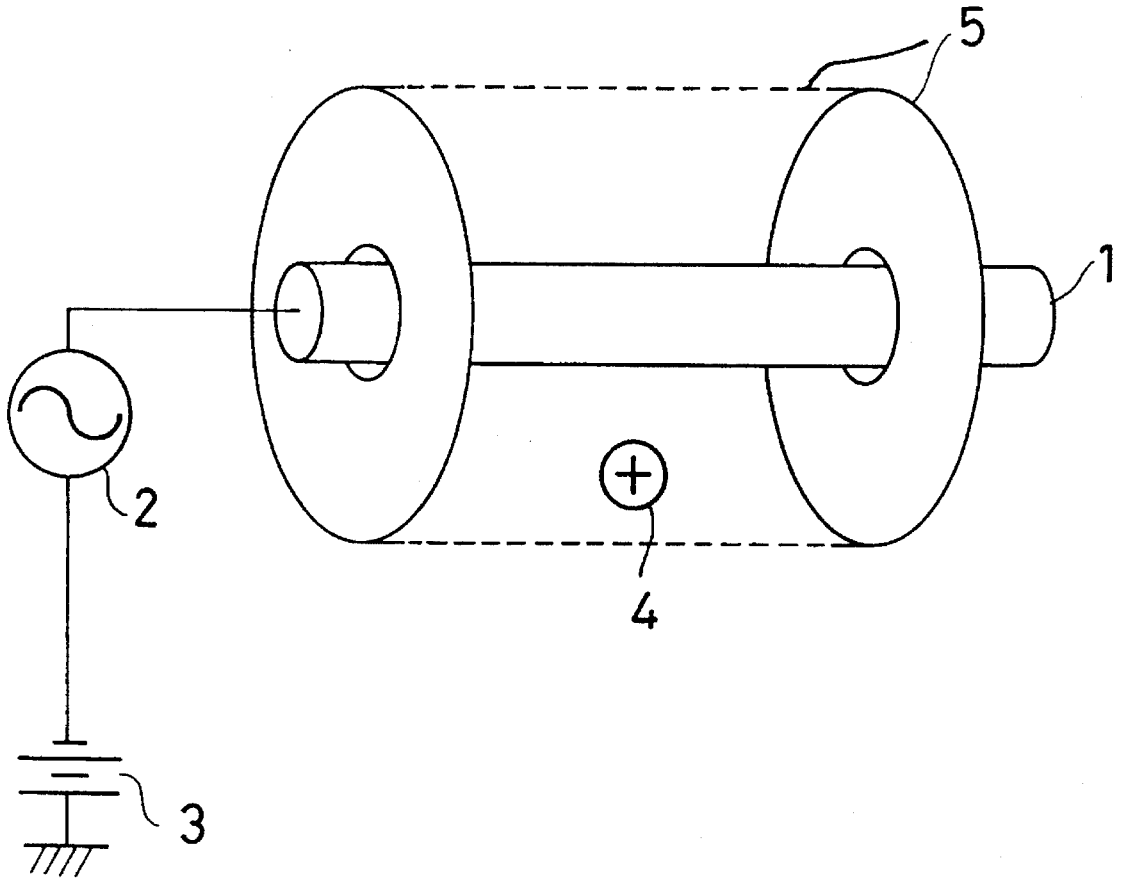
FIG. 2 is a schematic view showing the principle of a first embodiment of a method and apparatus for trapping charged particles according to the present invention, which uses a single central electrode.
Figure 3:
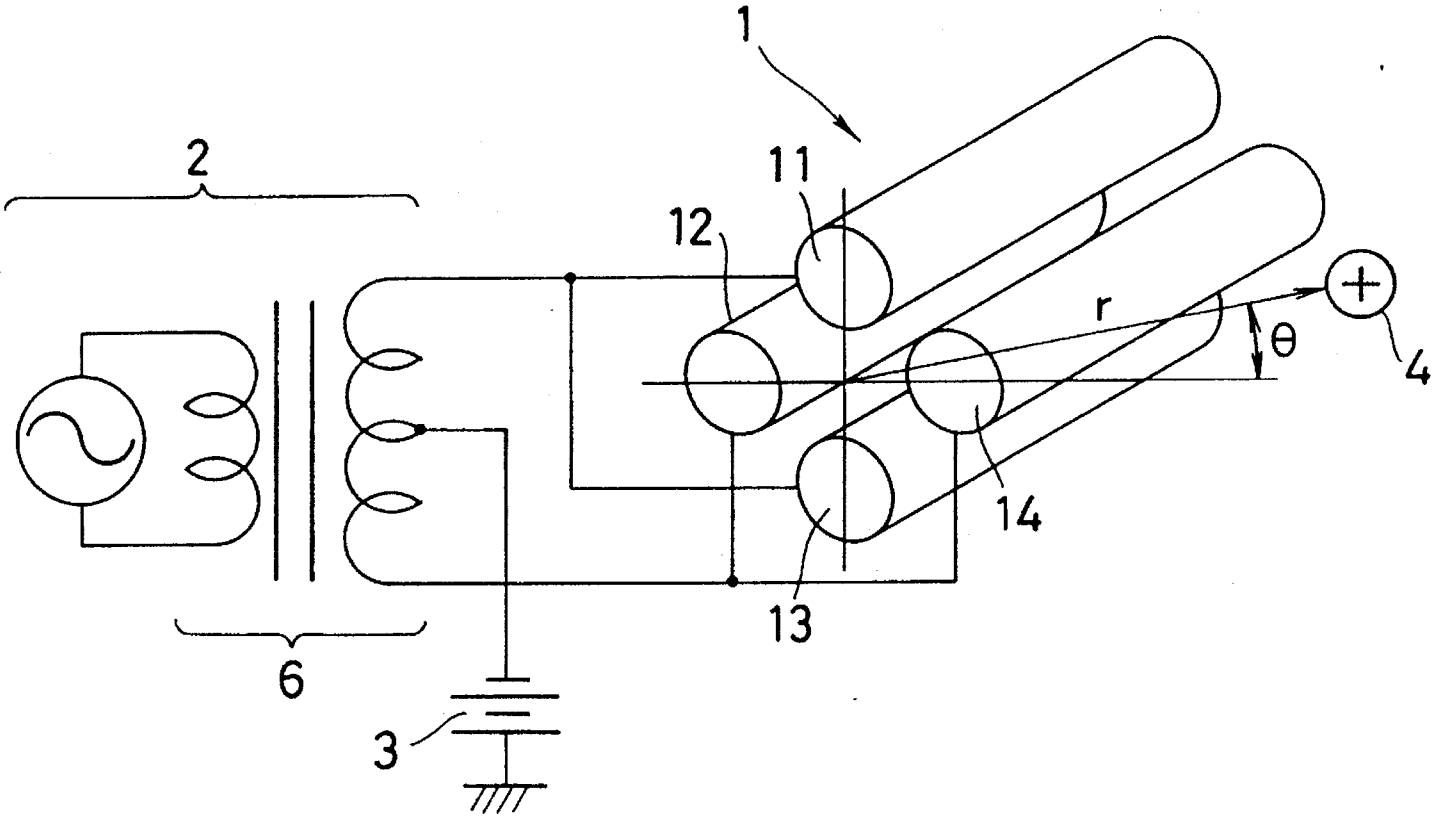
FIG. 3 is a schematic view showing a variation of the first embodiment as shown in FIG. 2, and includes a central electrode consisting of four element electrodes.
Figure 4:
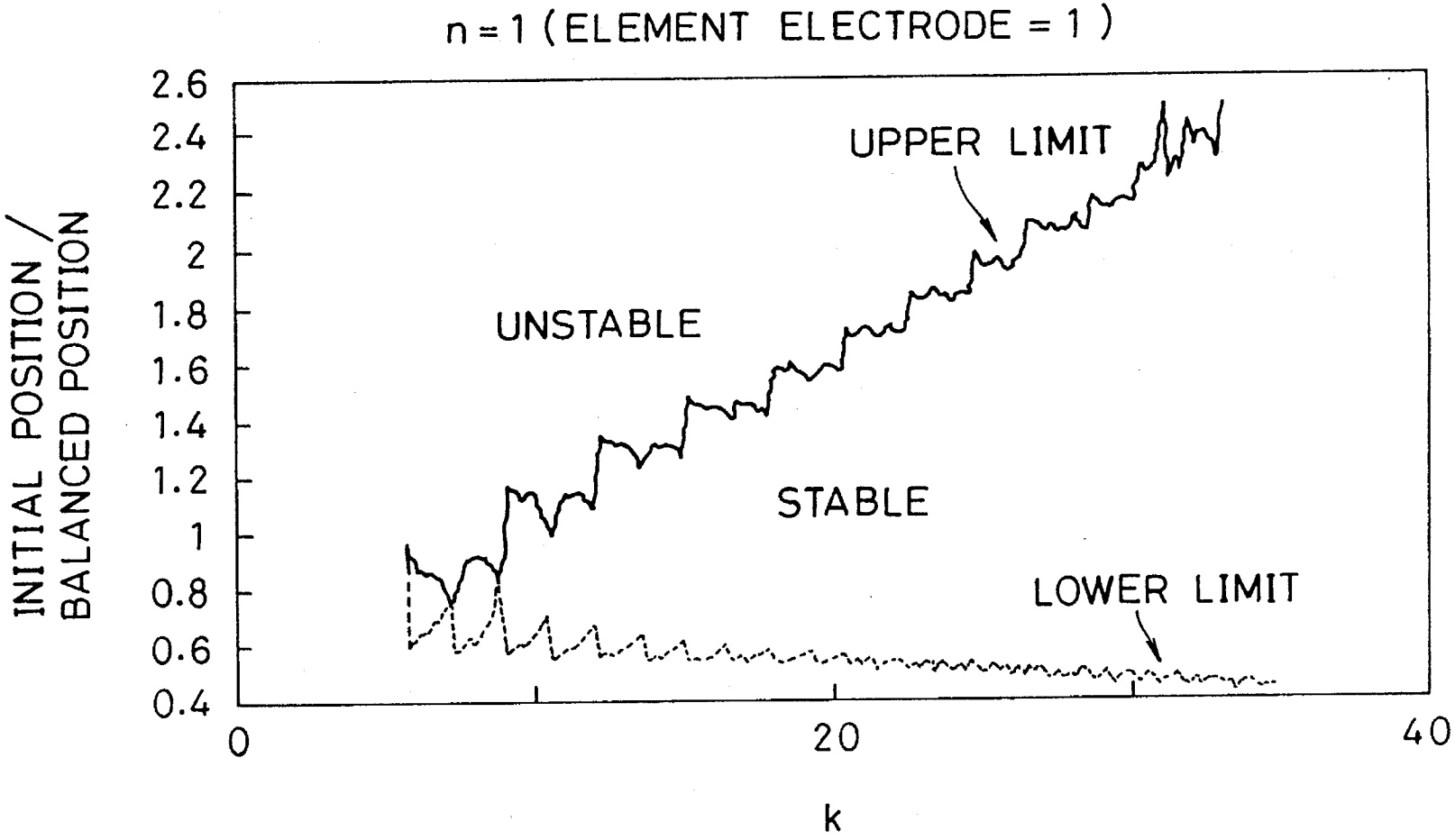
FIG. 4 is a graph illustrating the range in which charged particles are stably trapped by the apparatus using a single central electrode (n=1) as shown in FIG. 2.
Figure 5:
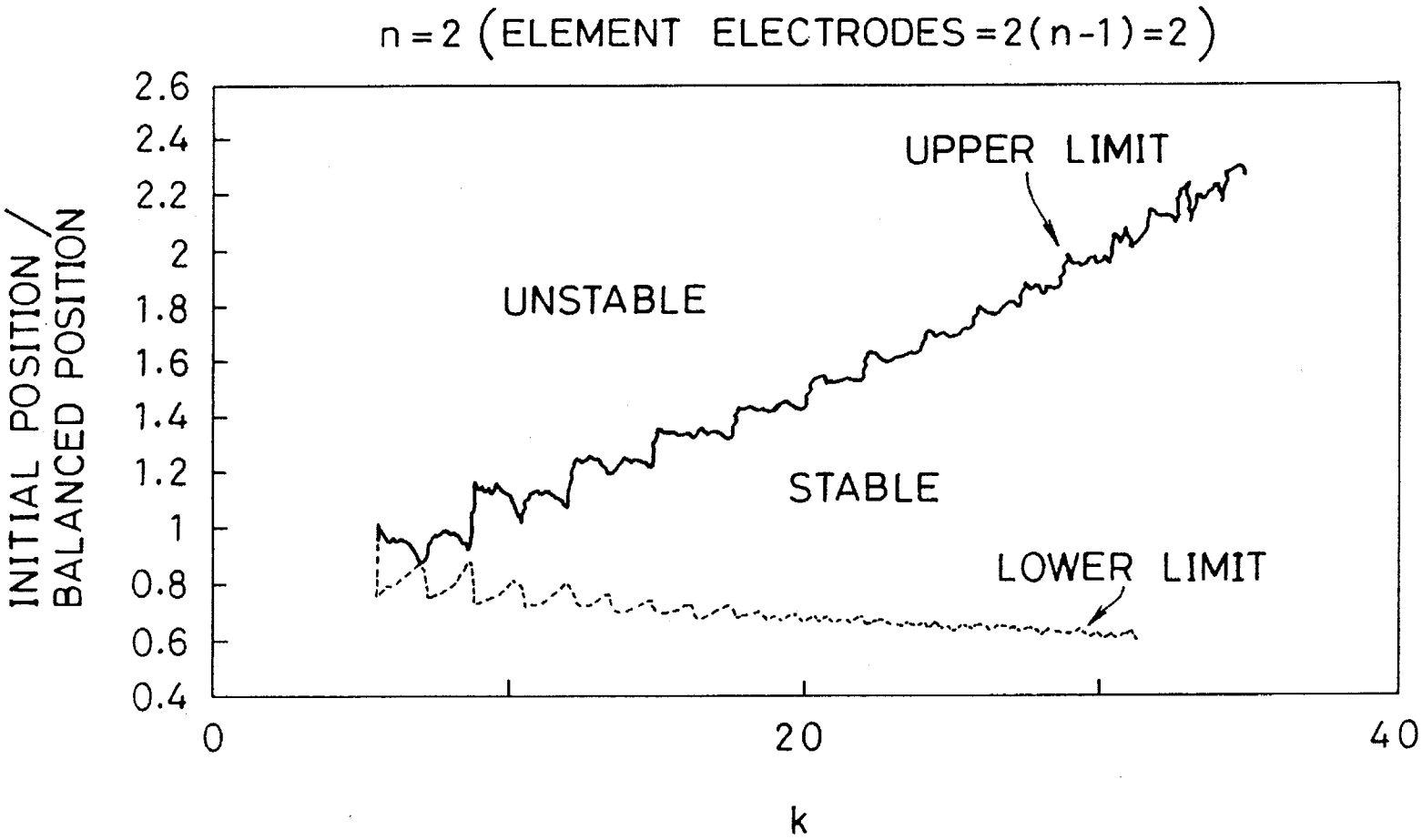
FIG. 5 is a graph illustrating the range in which charged particles are stably trapped by an apparatus using a central electrode consisting of two element electrodes (n=2)
Figure 6:
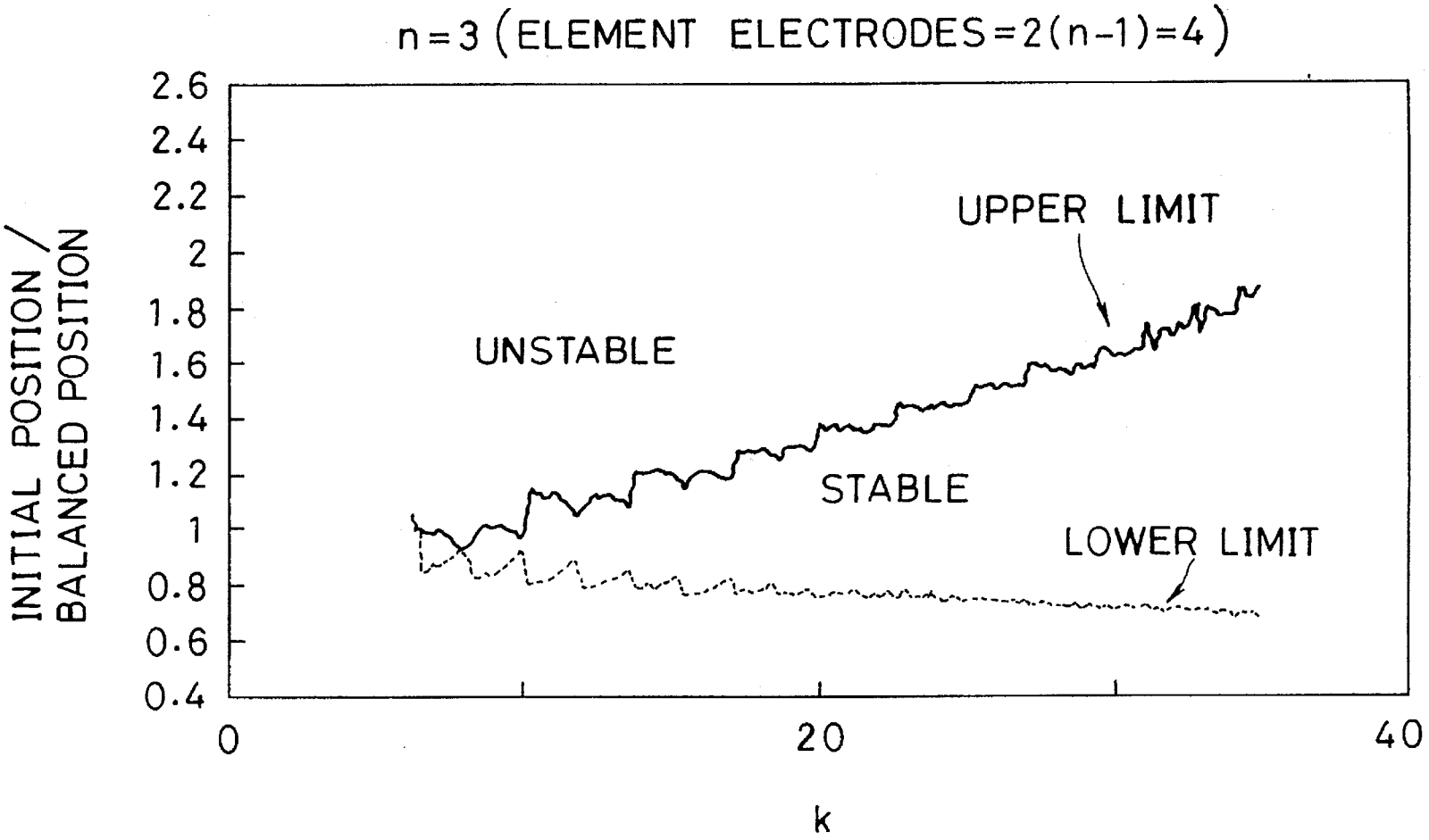
FIG. 6 is a graph illustrating the range in which charged particles are stably trapped by the apparatus using a central electrode consisting of four element electrodes (n=3) as shown in FIG. 3.
Figure 7:
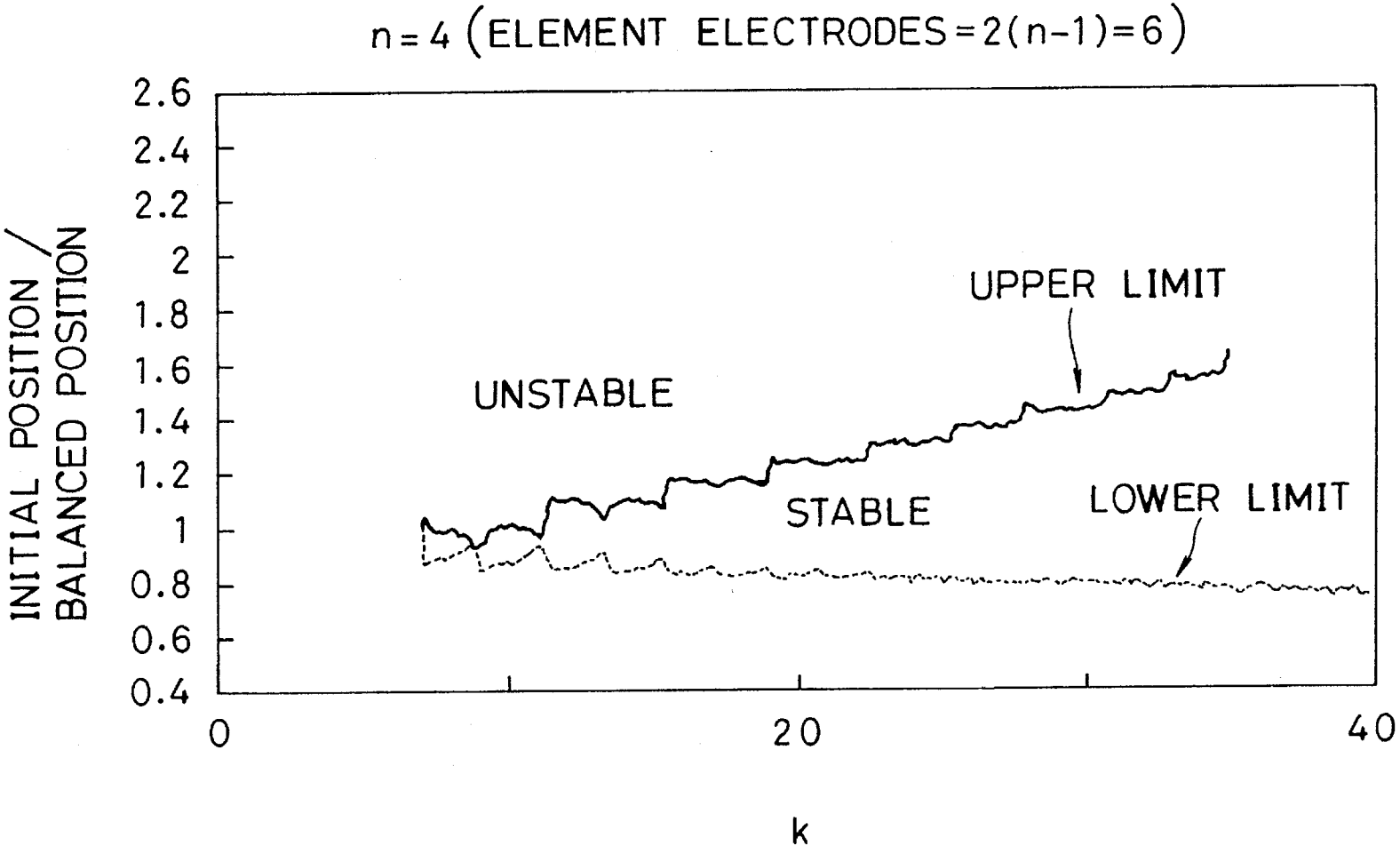
FIG. 7 is a graph illustrating the range in which charged particles are stably trapped by an apparatus using a central electrode consisting of six element electrodes (n=4)

FIGS. 2 and 3 are schematic views showing a first embodiment of an apparatus for trapping charged particles according to the present invention, and a variation of the first embodiment, respectively.

In these figures, a central electrode 1 is connected to an alternating current (AC) power supply 2. The alternating voltage produced by the AC power supply 2 is superimposed on a DC bias voltage produced by a direct current (DC) power supply 3. Thus, the alternating voltage and the DC voltage are superimposed, and are applied to the central electrode 1. The DC voltage is for attracting charged particles 4 to the central electrode 1. For example, in order to trap positive ions, a negative DC voltage is applied to the central electrode 1 as shown in these figures. In this case, an outer electrode 5 surrounding the central electrode 1 is required to define the electric field around the central electrode 1. The outer electrode 5, however, is sufficient as long as it surrounds the outside of the central electrode 1, and the shape thereof is not important because only the electric field close to the central electrode 1 is important in the present invention. It is not necessary for the outer electrode 5 to be constructed as compact as the conventional electrodes of FIG. 1. As the outer electrode 5 of the present invention, a vacuum vessel or an isolation vessel can be employed by itself. A vacuum vessel may be convenient because charged particles like ions or electrons are usually trapped in vacuum. An isolation vessel which prevents dust and electric noises from entering the interior may be convenient even if a vacuum is not utilized. Using an axially symmetrical central electrode, as shown in FIGS. 2 and 3, requires an outer electrode 5 at each end of the central electrode 1 so as to prevent the particles from escaping along the axis because no confining force acts on the particles in the axial direction (in FIG. 3, the outer electrodes 5 are omitted to simplify the drawing). To circumvent such a problem, a three dimensional central electrode such as a spherical electrode can be used. In this case, however, there arises the problem that it becomes difficult to support the electrode or to supply the voltage thereto. Accordingly, only the axially symmetrical electrodes as shown in FIGS. 2 and 3 are explained. The present invention, however, can be easily applied to the three dimensional electrodes if the problem of electrode supporting and voltage supplying are solved.

According to the method and apparatus of the present invention, charged particles are trapped by electrostatic attraction. Therefore, the applied voltage is directly transformed into the force for trapping the charged particles, thereby increasing the efficiency, widening the energy range of the trapped particles, and increasing the density of the trapped particles. The trapped particles would finally collide with the central electrode 1 due to the DC voltage applied to the central electrode 1 if it were not for the AC voltage. The collisions are prevented by superimposing the AC voltage on the DC voltage in the present invention. Since the intensity of the AC electric field declines as the distance from the central electrode increases, the AC electric field force averaged over time pushes the charged particles away from the central electrode 1. Thus, the AC electric field force balances the attraction by the DC electric field, and holds the charged particles in suspension in the space.

The present invention is distinctly different from the conventional method in the following: The present invention traps the charged particles by using the DC voltage applied to the central electrode 1 while the AC voltage serves only to prevent the charged particles from colliding with the central electrode 1. The conventional method, on the other hand, confines the charged particles in the space within the electrodes by separating the charged particles from the electrode by using the radio frequency electric field. Consequently, in the present invention, it is not important to accurately control the profile of the radio frequency electric field, and it is not necessary to precisely set the geometry of the central electrode 1 as well.

The first embodiment uses a central electrode 1 consisting of a single element as shown in FIG. 2. As a result, only a fixed trapping characteristic is accomplished because the attenuation characteristics of the AC electric field and the DC electric field are fixed with respect to the distance from the central electrode 1.

FIG. 3 illustrates a variation of the first embodiment. It uses a central electrode 1 consisting of an even number (four in FIG. 3) of element electrodes 11–14 so that the attenuation characteristics of the AC electric field and the DC electric field can be made different by changing the mode of applying a DC voltage and an AC voltage to the element electrodes 11–14 so that the trapping characteristics can be altered. The principle of the present invention will be further explained below.

The central electrode 1 is composed of 2(n−1) cylindrical element electrodes symmetrically arranged about the central axis, where n is an integer greater than one. Respective adjacent element electrodes (11 and 12, or 11 and 14, for example) are supplied with AC voltages of opposite phases from the AC power supply 2. A DC voltage is commonly applied to all of the element electrodes. FIG. 3 shows an example where n=3, that is, an example of a quadrupole. The AC power supply 2 comprises a transformer 6, and supplies opposite phase voltages to the four element electrodes 11–14 alternately. In this figure, the element electrodes 11 and 13 are supplied with a first voltage of an identical phase, and the element electrodes 12 and 14 are supplied with a second voltage whose phase is opposite to that of the first voltage. Thus, the AC voltages supplied to adjacent element electrodes, such as 11 and 12, have opposite polarity. Assuming that the angular frequency of the AC voltage is ω, and the charge and mass of the charged particles 4 are q and m, respectively, and that the AC electric field acting on the charged particles 4 in the radial direction outside the central electrode 1 is Eacr, and that the AC electric field acting on the charged particles 4 in the circumferential direction is Eacθ, and that the DC electric field acting on the charged particles 4 in the radial direction outside the central electrode 1 is Edc, these electric fields are expressed as follows:

$$Eacr=a\cdot\cos(n-1)\theta\cdot\cos\omega t/r^n \quad (1)$$

$$Eac\theta=a\cdot\sin(n-1)\theta\cdot\cos\omega t/r^n \quad (2)$$

$$Edc=-A/r \quad (3)$$

where a and A are coefficients representing the magnitudes of the AC electric field and DC electric field, respectively, and are proportional to the voltages applied to the electrodes, and r and θ are angular coordinates of the particle measured from the central axis. In these equations, higher order terms proportional to cos(n−1)jθ, where j is an integer larger than 1, and the DC field along the θ direction are neglected. However, since these terms decrease rapidly as the distance r from the center increases, the above equations give a sufficient approximation for the present purpose. This approximation becomes particularly good, when the arrangement of the element electrodes is adequately selected. For example, the four cylindrical electrodes of FIG. 3 should be arranged with a separation equal to the cylinder diameter, for this purpose. When n is set at n=1 in these equations, the arrangement as shown in FIG. 2 wherein the AC electric field and the DC electric field exhibit the same attenuation characteristics with regard to the distance from the central electrode 1 can also be discussed by using equations (1)–(3). Accordingly, in the following explanation, it is assumed that n=1 is included, and so, n is an integer equal to or greater than one.

The AC electric field, when averaged over the time axis, produces a radial force Fr whose magnitude Frm is expressed by equation (4) which operates as a repulsion force from the central axis.

$$Frm=nqa^2/2m\omega^2r^{(2n+1)} \quad (4)$$

This repulsion, when it balances the DC attraction, enables the charged particles to be trapped near a balanced position ro of the two forces expressed as follows:

$$ro=(nqa^2/2m\omega^2A)^{1/2n} \quad (5)$$

As shown in equation (5) the balanced position ro is inversely proportional to the ½n-th power of the mass m when the central electrode 1 consists of 2(n−1) element electrodes. This indicates that the method of the present invention can trap particles in a very wide mass range. For example, when n varies as 1, 2 and 3, the balanced position ro varies in accordance with ½-, ¼- and 1/6-th power of the mass m, respectively. Consequently, when a trapping space is available whose radius is 10 times the radius of the central electrode 1, for example, the mass range of the particles that can be trapped extends to $10^2$, $10^4$ and $10^6$. Thus, in order to widen the mass range for trapping, it is advantageous to use a central electrode having a greater n, that is, consisting of a larger number of element electrodes. The present invention gives another advantage in that the trapped particles of various masses are arranged in the trapping space in the order of their masses because the balanced positions vary in accordance with the masses of the particles as expressed by equation (5).

FIGS. 4–7 illustrate the results of simulations in which the motion of particles in the electric fields when n varied from one to four was simulated, and the ranges were obtained in which the particles were stably trapped. The equation of motion of the particles in the electric field can be expressed as follows when θ=0.

$$d^2X/dT^2=\cos T/kX^n-1/k^2X \quad (6)$$

where k is a dimensionless parameter indicating the intensity of the AC electric field against the DC electric field, which is expressed by the following equation (7), and X and T are expressed by equations (8) and (9), respectively.

$$k=(a^2(m\omega^2/q)^{n-1}/A^{n+1})^{1/2n} \quad (7)$$

$$X=r/(qa^2/m\omega^2A)^{1/2n} \quad (8)$$

$$T=\omega t \quad (9)$$

Equation (7) was numerically solved by varying the initial positions of the particles, and the ranges in which the particles were stably trapped were obtained as shown in FIGS. 4–7.

In FIGS. 4–7, values corresponding to the initial positions are normalized by the balanced position, and are represented against the parameter k. Here, solid lines indicate the upper limits of the range in which the particles are trapped stably, and broken lines indicate lower limits thereof. Although particles set in the range between these two lines perform stable, periodic motion, particles set outside the lines are accelerated by the AC electric field to be indefinitely separated from or collided with the central electrode 1. The lines undulate because such accelerations take place resonantly. The period τ of vibration of the trapped particles is expressed by the following equation:

$$\tau=2\pi k(n/2)^{1/2\,n}/(2n)^{1/2}\omega \quad (10)$$

Accordingly, the resonant acceleration readily occurs when k is small. This explains the reason why stable regions do not exist where k is small. The lower limit of the value k gives the lower limit of the mass that can be trapped.

As mentioned above, FIGS. 4–7 only illustrate the results of motions on the axis of θ=0. In practice, however, the motion of particles is not restricted to one axis, but is allowed to revolve around the central axis. Therefore, the stable ranges are much broader than those shown in these figures. In addition, it was ensured by computation that the stable range could be greatly extended by introducing inert gas such as Helium into the trapping space so as to disperse the particle energy, thus to prevent the vibration of the particles. The technique of introducing inert gas per se was known in the prior art.

Comparing FIGS. 4–7, it is found that although the lower limits of k change little as the value n varies, the stable ranges increase as the value n decreases. Further, the stable positions become closer to the central electrode 1 as the value k increases, thus resulting in collision of the particles with the central electrode at last, which gives the upper limits of the value k. Since the maximum value kmax of k is given by equation (11), when n≧2, the maximum value kmax increases consistently with the value n.

$$k_{max}=(n/2)^{(n-1)/2n}(n-1)V_{ac}/A \quad (11)$$

where $V_{ac}$ is the amplitude of the AC voltage supplied to the element electrodes, and the electrode arrangement is assumed to be selected to minimize the deviation of the electric field from equations (1)–(3).

It has been already stated that the mass range in which the particles are trapped in a space of particular dimensions increases as the value n Increases.

Figure 1A:
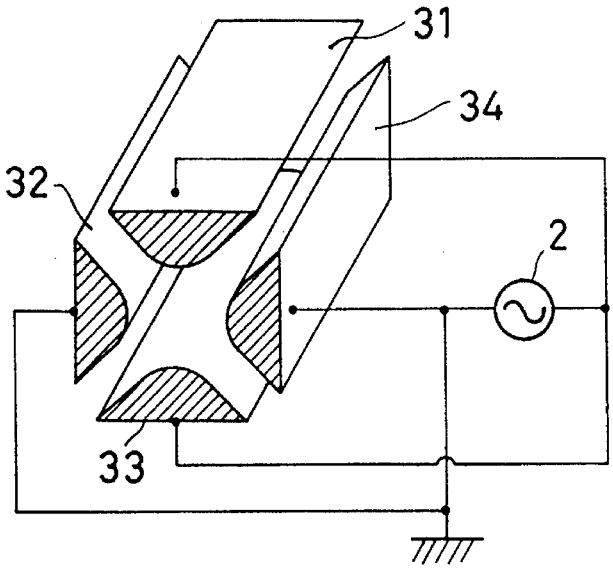
FIG. 1A (PRIOR ART)
FIGS. 1A–1C are schematic perspective views illustrating conventional apparatuses for trapping charged particles.
Figure 1B:
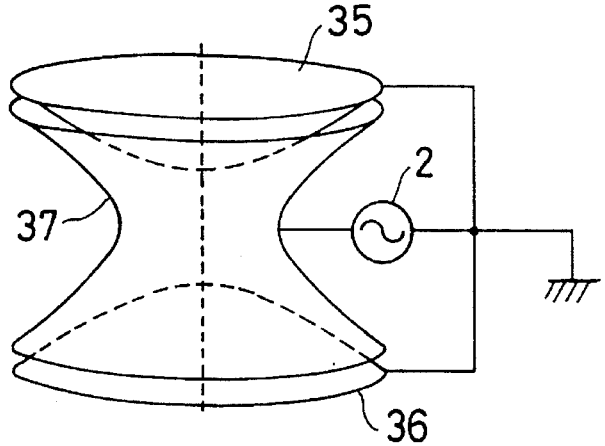
FIG. 1B (PRIOR ART)
Figure 1C:
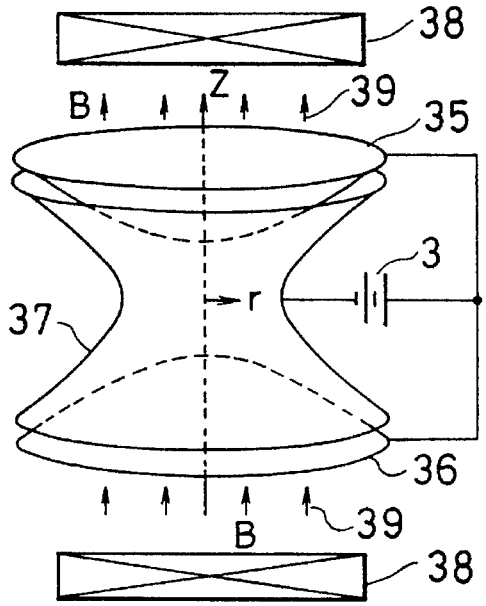
FIG. 1C (PRIOR ART)

Considering these factors, the quadrupole central electrode 1 as shown in FIG. 3 is the most practical arrangement. The quadrupole central electrode 1 of the present invention is characterized in that it can not only trap charged particles outside the central electrode 1, but it also can trap particles inside the quadrupole (that is, inside the central electrode 1) based on the conventional method as shown in FIG. 1A. The trapping of the charged particles inside the quadrupole depends on the mass of the particles as stated before. Accordingly, the method and apparatus of the present invention can trap not only particles of a wide mass range outside the central electrode 1, but also particles of a particular mass inside the central electrode 1. This presents a great advantage in applying the method and apparatus of the present invention for the purpose of crystal growth or the like. For example, crystals, which have been grown outside the central electrode 1 by feeding a raw material there while suspending the charged particles outside the quadrupole, can be transferred to the interior of the quadrupole when the crystals have grown to a predetermined mass.

Embodiment 2

Another more practical embodiment is described with reference to FIG. 8.

Figure 8:
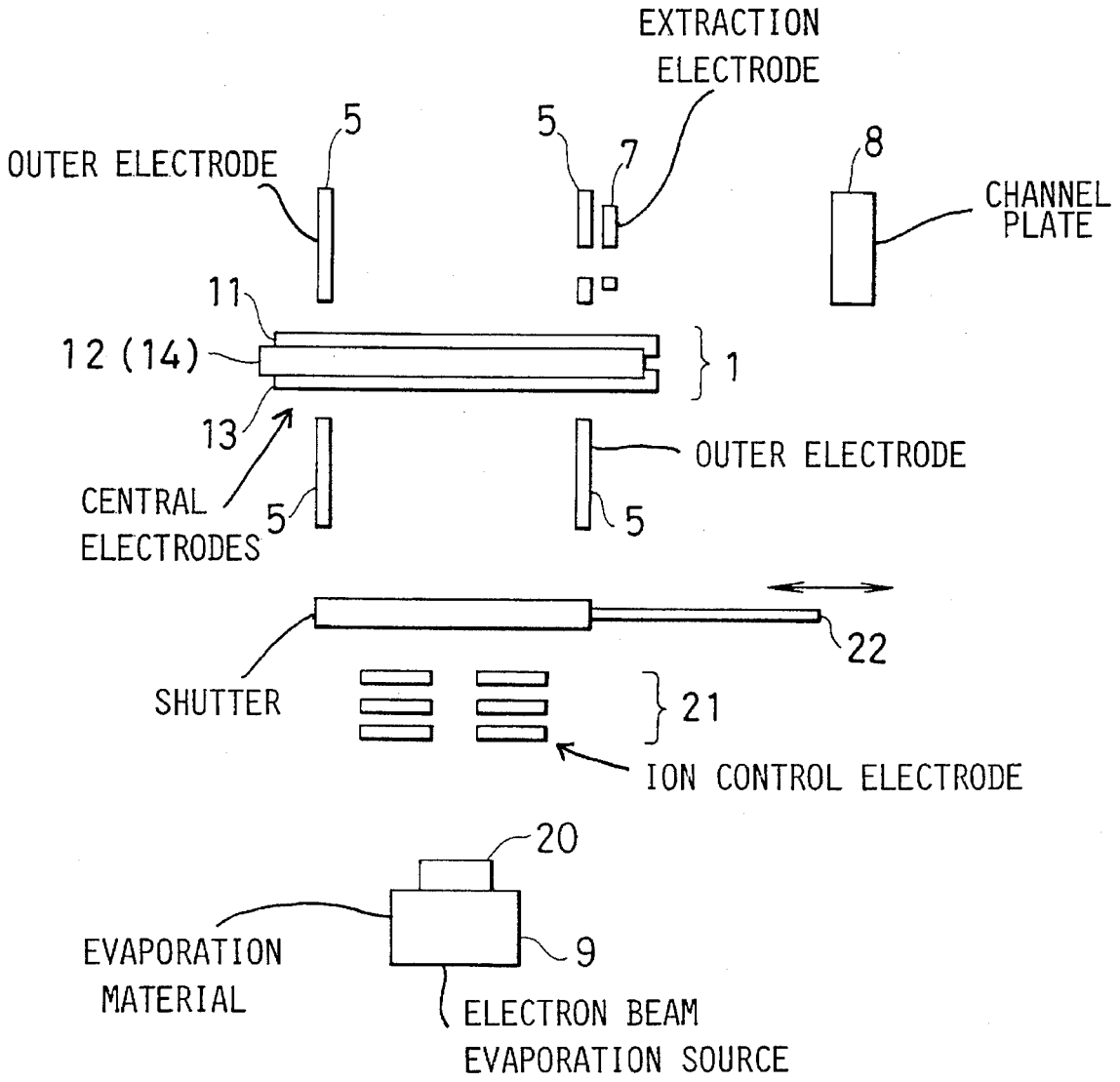
FIG. 8 is a schematic view showing a second embodiment of a method and apparatus for trapping charged particles according to the present invention.

With the arrangement of FIG. 8, Si fine crystals could be grown by feeding Si vapor thereto while trapping Si ions. This embodiment employs the arrangement as shown in FIG. 3: Four element electrodes 11–14 are symmetrically disposed about a central axis. The four element electrodes 11–14 are made of aluminum cylinders 1 cm in diameter and are disposed in such a manner that the centers of the cylinders are placed on a 1 cm radius circle centered on the central axis, thus forming a central electrode 1. The central electrode 1 is set in a 30 cm inner diameter vacuum vessel made of an aluminum alloy. The vessel itself is used as an outer electrode. Thus, the outer electrode is separated from the central axis by about 15 cm. Aluminum is used as the electrodes because of its high electric conductivity, nonmagnetism, and low outgassing in vacuum. The vacuum vessel is drawn to a pressure less than $10^{-7}$ Pa by using a turbomolecular pump.

At each end of the central electrode 1, there is provided a disk-like outer electrode 5 which has an aperture at its center, and prevents trapped charged particles from escaping along the axis. In addition, the right outer electrode 5 has another opening outside of which a drawout or extraction electrode 7 is provided. The drawout electrode 7 is provided for drawing trapped charged particles out of the trapping space by applying a negative pulse voltage so that the mass of the trapped particles is measured by the time-of-flight method by detecting them with a channel plate 8 provided at the right side of FIG. 8.

An electron beam evaporation source 9 is disposed under the vacuum vessel. The electron beam evaporation source 9 heats polysilicon as a evaporation material 20 by using electron beams so as to simultaneously supply Si ions and neutral atoms. Between the electron beam evaporation source 9 and the central electrode 1, there are provided an ion control electrode 21 and a movable shutter 22.

Trapping of Si ions could be confirmed by applying voltages to the central electrode 1 under the following conditions: By using the circuit employing the transformer 6 as shown in FIG. 3, all the four element electrodes 11–14 were supplied with a DC voltage of −12 V, and any adjacent element electrodes were supplied with AC voltages of opposite phases whose frequency was 85 kHz and whose root-mean-square voltage was 310 V. Maintaining these voltages, the electron beam evaporation source 9 was operated, and the ion control electrode 21 was supplied momentarily with a voltage of −10 V so that the ions were drawn into the trapping space to be trapped about the central electrode 1. The ion trapping was confirmed as follows: First, the ion control electrode 21 was supplied with a voltage of +50 V, and at the same time, the shutter 22 was closed so that the ion flow from the electron beam evaporation source 9 was prevented; second, this state was kept for a certain duration; and third, the drawout electrode 7 was supplied with a pulse-like drawout voltage, and the drawn-out ions were counted with the channel plate 8. Under these conditions, a count signal was obtained for more than one hour, which proved that the Si ions were stably trapped. When the frequency of the AC voltage was increased to 120 kHz while maintaining the other conditions as stated above, the count number increased. The increase in the frequency to caused the value of the dimensionless parameter k to increase. Thus, the increase in the value k enhanced the trapping stability as predicted theoretically before with reference to FIGS. 4–7. Further, the trapping stability was greatly improved by dispersing the particle energy by introducing $10^{-3}$ Pa He gas into the vacuum vessel. This was confirmed by the fact that the count signal was less attenuated with the elapse of trapping time.

Under the conditions mentioned above, while trapping Si ions, crystal growth using the trapped Si ions as seeds was achieved by feeding neutral Si atoms from the electron beam evaporation source 9. During this process, the shutter 22 was kept open and the ion control electrode 21 were supplied with a voltage of +50 V, thus preventing inflow or outflow of ions so that only neutral Si atoms were fed. The feed amount was approximately $10^{-4}$ Pa at the maximum in terms of pressure in the trapping space. After feeding for a predetermined time, the crystal growth was observed by measuring the masses of the trapped particles by the time-of-flight method. It was observed that the crystals had grown to a mass corresponding to $2\times10^4$ atoms in a thirty minute growth time. In addition, it was confirmed that particles of increased mass existed in close proximity to the central electrode 1 by shifting the position of the opening of the drawout electrode 7. It was further confirmed that the particles of increased mass were also trapped inside the element electrodes 11–14 by a measurement using the channel plate 8, and that there was little variation in the mass and size of the particles contained inside the electrodes 11–14. To achieve the inside trapping, small cuts were made in the element electrodes 11 and 12 to form a channel through which the charged particles could enter the inside from the outside. It was found that the particles trapped inside the electrodes 11–14 had diameters of approximately 10 nm by observing particles sampled on thin film holders for an electron microscope with a transmission electron microscope.

Next, Si particles grown under the above-stated conditions were reformed by oxidizing the surfaces thereof while maintaining their suspended state around the central electrode 1. They were held in a suspended state for about one hour after feeding $10^{-3}$ Pa oxygen. Subsequently, it was confirmed that the surfaces were reformed by observing sampled particles with a transmission electron microscope. Thus, it was found that the oxidization of the surfaces of Si fine crystals was achieved while maintaining the trapped state in the space. In the prior art trapping methods, such treatment accompanying mass changes is extremely difficult because the trapping parameters must be altered in accordance with the mass change, and in addition, an opening for feeding gas must be provided in the trapping electrode. In contrast with this, the method and apparatus of the present invention can easily accomplish it because changes in the shape of electrodes and parameters are not required.

The above-mentioned voltages were changed, and the growth of fine crystals following the trapping of the Si ions was carried out in a similar way. In this case, the DC voltage was set at −25 V, the frequency of the AC voltage was set at 150 kHz, and the root-mean-square voltage thereof was set at 400 Vrms. The sizes of fine crystals grown in this process were up to approximately 5 nm in diameter, consisting of $6\times10^3$ Si atoms. Trapping power was increased by an amount corresponding to the increase in the DC voltage so that the number of crystals grown in a single process was nearly doubled.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method for trapping charged particles, comprising the steps of:

providing a set of central electrodes around a central axis;

providing an outer electrode which substantially encloses said set of central electrodes;

generating a static DC electric field exerting on said charged particles forces directed to the central axis;

generating an AC electric field having an intensity which decreases with an increase in the distance from said central axis; and superimposing said AC electric field on said DC electric field, thereby trapping charged particles in a space between said set of central electrodes and said outer electrode.

2. A method for trapping charged particles as claimed in claim 1, wherein said AC electric field and said DC electric field have different attenuation characteristics with regard to the distance from said central axis.

3. A method for trapping charged particles as claimed in claim 1, wherein said set of central electrodes passes through said outer electrode.

4. An apparatus for trapping charged particles, comprising:

a set of central electrodes disposed around a central axis;

an outer electrode which substantially encloses said set of central electrodes;

an AC voltage source connected to said central electrodes for generating an electric field having an intensity which decreases with an increase in the distance from said central axis; and a DC voltage source connected to said AC voltage source for generating an electric field exerting on said charged particles forces directed to said central axis, said DC electric field being superimposed on said AC electric field, thereby trapping charged particles in a space between said set of central electrodes and said outer electrode.

5. An apparatus for trapping charged particles as claimed in claim 4, wherein said set of central electrodes consists of an even number of element electrodes which are symmetrically disposed around said central axis, said element electrodes being supplied by said AC voltage source in such a manner that any two adjacent element electrodes are supplied with AC voltages of opposite phases.

6. An apparatus for trapping charged particles as claimed in claim 4, wherein said set of central electrodes comprises four element electrodes.

7. An apparatus for trapping charged particles as claimed in claim 5, wherein said set of central electrodes has a trapping space inside said even number of element electrodes so that charged particles are trapped inside said set of central electrodes as well as outside said set of central electrodes.

8. An apparatus for trapping charged particles as claimed in claim 6, wherein said set of central electrodes has a trapping space inside said four element electrodes so that charged particles are trapped inside said set of central electrodes as well as outside said set of central electrodes.

9. An apparatus for trapping charged particles as claimed in claim 4, wherein said central electrodes are disposed in an axially symmetrical group having ends, said central electrodes passing through said outer electrode.

10. An apparatus for trapping charged particles as claimed in claim 4, wherein said outer electrode comprises a casing of a vacuum vessel containing said set of electrodes.

11. An apparatus for trapping charged particles as claimed in claim 4, wherein said outer electrode comprises a casing of an isolation vessel containing said set of electrodes.

12. An apparatus for trapping charged particles as claimed in claim 4, further comprising:

an evaporation source provided outside said outer electrode for emitting a beam of ions and neutral atoms of an evaporated material toward said set of central electrodes; and a shutter admitting or blocking the beam transmitted toward said set of central electrodes.

13. An apparatus as claimed in claim 12, further comprising an extraction electrode and a channel plate outside said outer electrode so that charged particles inside said outer electrode are drawn out to be counted with said channel plate.

14. An apparatus as claimed in claim 4, wherein the AC voltage source has a first terminal which supplies an AC voltage having a first phase and a second terminal which supplies an AC voltage having a second phase, the first terminal being connected to a first electrode of said set of central electrodes, and the second terminal being connected to a second electrode of said set of central electrodes, the first and second electrodes of said set of central electrodes being spaced apart and parallel to one another.

15. An apparatus as claimed in claim 14, wherein the AC voltage source comprises a transformer having a winding with a first end which provides the first terminal and a second end which provides the second terminal, the winding additionally having a center tap which is connected to the DC voltage source.

16. An apparatus as claimed in claim 15, further comprising at least one additional electrode of said set of central electrodes, all of the electrodes of said set of central electrodes being spaced apart and parallel to one another, and each additional electrode of said set of central electrodes being connected to one of the first and second terminals.

17. An apparatus for trapping charged particles, comprising:

a central electrode;

an outer electrode which substantially encloses said central electrode;

an AC voltage source connected to said central electrode for generating an electric field having an intensity which decreases with an increase in the distance from said central electrode;

a DC voltage source connected to said AC voltage source for generating an electric field exerting on said charged particles forces directed to the central electrode, said DC electric field being superimposed on said AC electric field;

an evaporation source for emitting a beam of ions and neutral atoms of an evaporation material toward said central electrode; and a shutter admitting or blocking the beam of ions and neutral atoms emitted toward said central electrode.

18. An apparatus for trapping charged particles as claimed in claim 17, further comprising an extraction electrode and a channel plate outside said outer electrode so that charged particles inside said outer electrode are drawn out to be counted with said channel plate.

19. An apparatus as claimed in claim 17, wherein said central electrode is cylindrical.

20. An apparatus for trapping charged particles as claimed in claim 17, wherein the central electrode has a first end which lies in a first plane and a second end which lies in a second plane, the planes being parallel to one another and perpendicular to the central electrode, and wherein the beam of ions and neutral particles is disposed between the first and second planes.

21. An apparatus as claimed in claim 20, wherein the ions are trapped in a space which is disposed between the first and second planes.

22. An apparatus for trapping charged particles as claimed in claim 17, wherein the charged particles are trapped in a space surrounding the central electrode.

23. An apparatus as claimed in claim 17, wherein the ions are trapped in a space surrounding the central electrode.

24. An apparatus for trapping charged particles, comprising:

a set of elongated electrodes which are disposed around a central axis and parallel to the central axis;

an AC voltage source connected to the elongated electrodes for generating an electric field having an intensity which decreases with an increase in the radial distance from the central axis;

a DC voltage source connected to the AC voltage source for generating an electric field exerting on the charged particles forces directed radially to the central axis, the DC electric field being superimposed on the AC electric field; and an outer electrode with a pair of spaced-apart ends that are substantially parallel to one another and substantially perpendicular to the central axis, the ends of the outer electrode having openings through which the set of elongated electrodes passes.

25. An apparatus for trapping particles, comprising:

an elongated electrode;

an AC voltage source;

a DC voltage source, the AC and DC voltage sources being connected in a series to the electrode; and means for emitting a beam of ions and neutral particles toward the electrode; and an outer electrode with a pair of spaced-apart ends that are substantially parallel to one another and substantially perpendicular to the elongated electrode, the ends of the outer electrode having openings through which the elongated electrode passes.

* * * * *